US012540424B2

(12) United States Patent
Dunn et al.

(10) Patent No.: US 12,540,424 B2
(45) Date of Patent: Feb. 3, 2026

(54) FLAME RESISTANT FABRICS FORMED OF LONG STAPLE YARNS AND FILAMENT YARNS

(71) Applicant: Southern Mills, Inc., Union City, GA (US)

(72) Inventors: Charles S. Dunn, Griffin, GA (US); Michael A. Laton, Fayetteville, GA (US); Brian John Walsh, Atlanta, GA (US); Scott Ritenour, Peachtree City, GA (US)

(73) Assignee: Southern Mills, Inc., Union City, GA (US)

( * ) Notice: Subject to any disclaimer, the term of this patent is extended or adjusted under 35 U.S.C. 154(b) by 693 days.

(21) Appl. No.: 17/112,724

(22) Filed: Dec. 4, 2020

(65) Prior Publication Data

US 2021/0172098 A1 Jun. 10, 2021

Related U.S. Application Data

(60) Provisional application No. 62/943,968, filed on Dec. 5, 2019.

(51) Int. Cl.
*D03D 15/513* (2021.01)
*D03D 15/283* (2021.01)
*D03D 15/292* (2021.01)

(52) U.S. Cl.
CPC ..... *D03D 15/513* (2021.01); *D03D 15/283* (2021.01); *D03D 15/292* (2021.01); *D10B 2331/02* (2013.01); *D10B 2401/041* (2013.01)

(58) Field of Classification Search
CPC ..... Y10T 442/313; Y10T 442/3293; Y10T 442/30–3992; Y10T 442/3276; Y10T 422/313; D10B 2331/021
USPC ..... 442/181–303
See application file for complete search history.

(56) References Cited

U.S. PATENT DOCUMENTS

| | | | |
|---|---|---|---|
| 279,669 | A | 6/1883 | Smith |
| 524,441 | A | 8/1894 | Johns |
| D89,157 | S | 1/1933 | Schweizer |
| 1,990,880 | A | 2/1935 | Jean |
| 2,106,457 | A | 1/1938 | Eli |
| D118,109 | S | 12/1939 | Callahan |
| 2,521,055 | A | 9/1950 | Foster |
| 2,619,705 | A | 12/1952 | Foster |
| 2,757,435 | A | 8/1956 | Lajos |
| 3,019,821 | A | 2/1962 | White |
| 3,036,602 | A | 5/1962 | Hans et al. |
| 3,347,969 | A | 10/1967 | Moelter |
| 3,511,747 | A | 5/1970 | Davies |
| 3,729,920 | A | 5/1973 | Sayers et al. |
| 3,949,111 | A | 4/1976 | Pelletier |
| 4,048,139 | A | 9/1977 | Calundann et al. |
| 4,198,494 | A | 4/1980 | Burckel |
| 4,219,996 | A | 9/1980 | Edgawa et al. |
| 4,304,811 | A | 12/1981 | David et al. |
| 4,469,744 | A | 9/1984 | Grot et al. |
| 4,470,251 | A | 9/1984 | Bettcher |
| 4,500,593 | A | 2/1985 | Weber |
| 4,602,385 | A | 7/1986 | Warren |
| 4,615,934 | A | 10/1986 | Ellison |
| 4,670,327 | A | 6/1987 | Weber |
| 4,748,065 | A | 5/1988 | Tanikella |
| 4,749,378 | A | 6/1988 | Cates et al. |
| 4,750,443 | A | 6/1988 | Blaustein et al. |
| 4,759,770 | A | 7/1988 | Cates et al. |
| 4,865,906 | A | 9/1989 | Smith, Jr. |
| 4,900,613 | A | 2/1990 | Green |
| 4,923,741 | A | 5/1990 | Kosmo et al. |
| 4,931,345 | A | 6/1990 | Boettger et al. |
| 4,941,884 | A | 7/1990 | Green |
| 4,958,485 | A | 9/1990 | Montgomery et al. |
| 4,967,548 | A | 11/1990 | Fangeat et al. |
| 4,996,099 | A | 2/1991 | Cooke et al. |
| D320,475 | S | 10/1991 | Jeter |
| 5,095,549 | A | 3/1992 | Aldridge |
| 5,119,512 | A | 6/1992 | Dunbar et al. |
| 5,120,599 | A | 6/1992 | Lewis |
| 5,136,723 | A | 8/1992 | Aldridge et al. |
| 5,141,542 | A | 8/1992 | Fangeat et al. |
| 5,177,948 | A | 1/1993 | Kolmes et al. |
| 5,202,086 | A | 4/1993 | Baliga et al. |
| 5,215,795 | A | 6/1993 | Matsumoto et al. |
| 5,233,821 | A | 8/1993 | Weber et al. |
| 5,299,602 | A | 4/1994 | Barbeau et al. |
| 5,323,815 | A | 6/1994 | Barbeau et al. |
| 5,344,698 | A | 9/1994 | Rock et al. |
| 5,447,787 | A | 9/1995 | Shaffer |
| 5,482,763 | A | 1/1996 | Shaffer |
| 5,499,663 | A | 3/1996 | Barbeau et al. |
| 5,527,597 | A | 6/1996 | Stanhope et al. |
| 5,538,781 | A | 7/1996 | Rao et al. |
| 5,560,990 | A | 10/1996 | Ilg et al. |
| 5,597,646 | A | 1/1997 | Keller |
| 5,624,738 | A | 4/1997 | Barbeau et al. |

(Continued)

FOREIGN PATENT DOCUMENTS

| | | |
|---|---|---|
| AT | 508653 | 3/2011 |
| CA | 2313995 | 8/2001 |

(Continued)

OTHER PUBLICATIONS

"Fibre To Yarn: Staple-Yarn Spinning." I.A. Elhawary. Textiles and Fashion. Materials, Design and Technology. Woodhead Publishing Series in Textiles. 2015, pp. 191-212. https://doi.org/10.1016/B978-1-84569-931-4.00009-X (Year: 2015).*

(Continued)

*Primary Examiner* — Marla D Mcconnell
*Assistant Examiner* — Kevin Worrell
(74) *Attorney, Agent, or Firm* — Kilpatrick Townsend & Stockton LLP

(57) ABSTRACT

Embodiments of the invention relate to flame resistant fabrics formed of a combination of filament and long staple yarns that exhibit excellent physical and thermal properties at relatively light weights.

20 Claims, No Drawings

(56) References Cited

U.S. PATENT DOCUMENTS 5,628,065 A 5/1997 Austin
5,637,114 A 6/1997 Hoehnke
5,654,067 A 8/1997 Dinger et al.
5,688,594 A 11/1997 Lichscheidt et al.
5,691,040 A 11/1997 Barbeau et al.
5,694,981 A 12/1997 Stanhope et al.
5,701,606 A 12/1997 Aldridge
5,858,888 A 1/1999 Underwood et al.
5,882,791 A 3/1999 Van Der Werff et al.
5,926,842 A 7/1999 Price et al.
5,928,971 A 7/1999 Ellis et al.
5,962,627 A 10/1999 Van Der Werff et al.
5,983,409 A 11/1999 Aldridge et al.
5,996,122 A 12/1999 Aldridge et al.
6,038,700 A 3/2000 Aldridge et al.
6,065,153 A 5/2000 Underwood et al.
6,132,476 A 10/2000 Lunsford et al.
6,146,759 A 11/2000 Land
6,192,520 B1 2/2001 Underwood et al.
6,211,099 B1 4/2001 Hutto, Jr. et al.
6,247,179 B1 6/2001 Underwood et al.
6,367,513 B1 4/2002 Cain
6,410,140 B1 6/2002 Land et al.
6,460,321 B1 10/2002 Koshimae et al.
6,534,175 B1 3/2003 Zhu et al.
6,547,835 B1 4/2003 Lunsford et al.
6,559,079 B1 5/2003 Bachner, Jr.
6,562,741 B1 5/2003 Lilani
6,606,749 B2 8/2003 Underwood et al.
6,624,096 B2 9/2003 Thomas et al.
6,668,868 B2 12/2003 Howland et al.
6,691,307 B2 2/2004 Long
6,691,317 B2 2/2004 Cochran
6,699,802 B1 3/2004 Hainsworth et al.
6,750,162 B2 6/2004 Underwood et al.
6,790,795 B2 9/2004 Erb, Jr. et al.
6,818,024 B2 11/2004 Lunsford et al.
6,840,288 B2 1/2005 Zhu et al.
6,867,154 B1 3/2005 Lunsford et al.
6,886,184 B2 5/2005 Underwood et al.
6,974,785 B1 12/2005 Barbeau et al.
7,119,036 B2 10/2006 Maini
7,132,376 B2 11/2006 Rashed
7,393,800 B2 7/2008 Corner
7,402,538 B2 7/2008 Bader et al.
7,537,831 B2 5/2009 Zhu et al.
7,581,260 B2 9/2009 Underwood et al.
7,589,036 B2 9/2009 Corner et al.
7,700,191 B2 4/2010 Zhu et al.
7,713,891 B1 5/2010 Li et al.
7,788,952 B2 9/2010 Morrison
7,811,952 B2 10/2010 Truesdale, III et al.
7,820,567 B2 10/2010 Zhu et al.
7,820,572 B2 10/2010 Zhu et al.
7,862,865 B2 1/2011 Truesdale, III et al.
7,992,596 B2 8/2011 Khokar
8,071,492 B2 12/2011 Hess et al.
8,166,743 B2 5/2012 Zhu et al.
8,209,785 B2 7/2012 Underwood et al.
D670,435 S 11/2012 Blackford
8,528,120 B2 9/2013 Underwood et al.
D695,530 S 12/2013 Javits, Jr.
8,614,156 B2 12/2013 Hess et al.
8,793,814 B1 8/2014 Diianni et al.
8,819,866 B2 9/2014 Underwood et al.
8,826,469 B2 9/2014 London
D747,076 S 1/2016 Reisler
9,259,599 B2 2/2016 Stanhope et al.
D751,274 S 3/2016 Moore
9,364,694 B2 6/2016 Underwood et al.
D767,824 S 9/2016 Hilliard
9,683,315 B2 6/2017 Schmitt et al.
9,706,804 B1 7/2017 Emery et al.
9,878,185 B2 1/2018 Underwood et al.
10,072,365 B2 9/2018 Birk et al.
D834,334 S 11/2018 Underwood et al.
10,428,446 B2 10/2019 Smith et al.
10,704,169 B2 7/2020 Habicht et al.
11,306,418 B2 4/2022 Stanhope et al.
2001/0009832 A1 7/2001 Shaffer et al.
2002/0026663 A1 3/2002 Underwood et al.
2002/0034905 A1 3/2002 Truesdale
2002/0106955 A1 8/2002 Underwood et al.
2002/0122908 A1 9/2002 Li et al.
2002/0124544 A1 9/2002 Land et al.
2002/0155773 A1 10/2002 Maini
2002/0164912 A1 11/2002 Fawcett et al.
2003/0040240 A1 2/2003 Thomas et al.
2003/0203690 A1 10/2003 Hess et al.
2003/0226612 A1 12/2003 Zhu et al.
2003/0228812 A1 12/2003 Stanhope et al.
2003/0228821 A1 12/2003 Zhu et al.
2004/0001978 A1 1/2004 Bader et al.
2004/0029473 A1 2/2004 McKee et al.
2004/0034905 A1 2/2004 Underwood et al.
2004/0065072 A1 4/2004 Zhu et al.
2004/0092187 A1 5/2004 Favier et al.
2004/0152378 A1* 8/2004 Stanhope ..... B32B 5/26 442/49
2005/0025962 A1 2/2005 Zhu et al.
2005/0025963 A1 2/2005 Zhu
2005/0032449 A1 2/2005 Lovasic et al.
2005/0155131 A1 7/2005 Underwood et al.
2005/0158559 A1 7/2005 Martin et al.
2005/0186875 A1 8/2005 Lilani
2005/0251900 A1 11/2005 Harlacker
2006/0154542 A1 7/2006 Underwood et al.
2006/0166577 A1 7/2006 Rashed
2006/0177656 A1 8/2006 Kolmes et al.
2006/0204753 A1 9/2006 Simmonds et al.
2006/0264136 A1 11/2006 Chiantese
2007/0072502 A1 3/2007 Underwood et al.
2007/0184737 A1 8/2007 Corner et al.
2008/0038973 A1 2/2008 Sasser et al.
2008/0057807 A1 3/2008 Tutterow et al.
2008/0095998 A1 4/2008 Thiriot
2008/0152906 A1 6/2008 Kobayashi et al.
2008/0299854 A1 12/2008 Hilleary et al.
2009/0019614 A1 1/2009 Hagihara et al.
2009/0053954 A1 2/2009 Zhu et al.
2009/0139016 A1 6/2009 Zhu et al.
2010/0029790 A1 2/2010 Lombardo
2010/0112312 A1 5/2010 Tutterow et al.
2010/0124862 A1 5/2010 Smith
2010/0154621 A1 6/2010 Nilakantan et al.
2010/0223717 A1 9/2010 Foy et al.
2010/0297905 A1 11/2010 Ulrich et al.
2011/0049949 A1 3/2011 Basmaji et al.
2011/0165807 A1 7/2011 Underwood et al.
2011/0191949 A1 8/2011 Underwood et al.
2011/0250452 A1 10/2011 Ke
2011/0281097 A1 11/2011 Li et al.
2012/0017191 A1 1/2012 Chen et al.
2012/0034835 A1 2/2012 Hess et al.
2012/0171918 A1 7/2012 Lawson, III et al.
2012/0180449 A1 7/2012 Reig et al.
2012/0270456 A1 10/2012 Gstettner et al.
2012/0278979 A1 11/2012 Underwood et al.
2013/0006547 A1 1/2013 Akada
2013/0008554 A1 1/2013 Fisher et al.
2013/0065470 A1 3/2013 Rock et al.
2013/0101781 A1 4/2013 Lee et al.
2013/0174334 A1 7/2013 Kuroda et al.
2013/0210306 A1 8/2013 Cobb et al.
2013/0254980 A1 10/2013 Underwood et al.
2013/0267140 A1 10/2013 Gstettner et al.
2014/0026303 A1 1/2014 Zhu
2014/0075659 A1 3/2014 Li et al.
2014/0206248 A1 7/2014 Vito
2014/0208491 A1 7/2014 Schmitt et al.
2014/0360619 A1 12/2014 Underwood et al.
2015/0121612 A1 5/2015 Favier et al.
2015/0176160 A1 6/2015 Lee et al.
2015/0233028 A1 8/2015 Tomiyori et al.

(56) References Cited

U.S. PATENT DOCUMENTS

| | | | |
|---|---|---|---|
| 2015/0297919 | A1 | 10/2015 | Stanhope et al. |
| 2016/0083877 | A1 | 3/2016 | Kalfa Kilickan et al. |
| 2016/0338433 | A1 | 11/2016 | Underwood et al. |
| 2016/0375277 | A1 | 12/2016 | Underwood et al. |
| 2017/0130372 | A1 | 5/2017 | Underwood et al. |
| 2017/0175302 | A1 | 6/2017 | Habicht et al. |
| 2018/0057978 | A1 | 3/2018 | Zhu |
| 2018/0195214 | A1 | 7/2018 | Wirth et al. |

FOREIGN PATENT DOCUMENTS

| | | | |
|---|---|---|---|
| CH | 681600 | | 4/1993 |
| CN | 1320179 | | 10/2001 |
| CN | 1659323 | | 8/2005 |
| CN | 1829831 | | 9/2006 |
| CN | 1829833 | | 9/2006 |
| CN | 1869301 | | 11/2006 |
| CN | 102985604 | | 3/2013 |
| CN | 103622186 | | 3/2014 |
| CN | 103906869 | | 7/2014 |
| CN | 108859342 | | 11/2018 |
| CN | 110117856 | A | 8/2019 |
| CN | 110117865 | | 8/2019 |
| DE | 4229546 | | 3/1994 |
| DE | 102005021943 | A1 | 12/2005 |
| DE | 202013101921 | | 5/2013 |
| EP | 0599587 | | 6/1994 |
| EP | 1416074 | A1 | 5/2004 |
| EP | 2644759 | | 10/2013 |
| EP | 3165644 | | 5/2017 |
| FR | 2649128 | | 1/1991 |
| GB | 2070077 | | 9/1981 |
| GB | 2275934 | | 9/1994 |
| GB | 2478854 | | 9/2011 |
| GB | 2516134 | | 1/2015 |
| JP | 1272836 | | 10/1989 |
| JP | 2191760 | | 7/1990 |
| JP | 2264030 | | 10/1990 |
| JP | 4024240 | | 1/1992 |
| JP | 04361636 | | 12/1992 |
| JP | 5125637 | | 5/1993 |
| JP | 6220730 | | 8/1994 |
| JP | 6226900 | | 8/1994 |
| JP | 7048754 | | 2/1995 |
| JP | 7292534 | | 11/1995 |
| JP | 8109530 | | 4/1996 |
| JP | 8226031 | | 9/1996 |
| JP | 8246287 | | 9/1996 |
| JP | 9078379 | | 3/1997 |
| JP | 9119038 | | 5/1997 |
| JP | 409310236 | | 12/1997 |
| JP | 10130990 | | 5/1998 |
| JP | 11279894 | | 10/1999 |
| JP | 2000008247 | | 1/2000 |
| JP | 2000045147 | | 2/2000 |
| JP | 2000144526 | | 5/2000 |
| JP | 2000234236 | | 8/2000 |
| JP | 2000256927 | | 9/2000 |
| JP | 2000273742 | | 10/2000 |
| JP | 2000303285 | | 10/2000 |
| JP | 2000303289 | | 10/2000 |
| JP | 2007500803 | | 1/2007 |
| JP | 2007530819 | | 11/2007 |
| JP | 2008025035 | | 2/2008 |
| JP | 2008530384 | | 8/2008 |
| JP | 2009280942 | | 12/2009 |
| JP | 2010502849 | | 1/2010 |
| JP | 2015-094043 | A | 5/2015 |
| JP | 2017-517651 | A | 6/2017 |
| JP | 2019-157279 | A | 9/2019 |
| JP | 6671306 | B2 | 3/2020 |
| RU | 2127536 | | 3/1999 |
| WO | 0066823 | | 11/2000 |
| WO | 0075410 | | 12/2000 |
| WO | 0157940 | | 8/2001 |
| WO | 2004067822 | | 8/2004 |
| WO | 2005019512 | | 3/2005 |
| WO | 2008075505 | A1 | 6/2008 |
| WO | 2010135214 | | 11/2010 |
| WO | 2011050376 | | 5/2011 |
| WO | 2011100202 | | 8/2011 |
| WO | 2013078287 | | 5/2013 |
| WO | 2014018221 | | 1/2014 |
| WO | 2015/004432 | A1 | 1/2015 |

OTHER PUBLICATIONS

"Excerpt from PBI products.com, Break strength and trap tear graphs", cited in Opposition filed Jan. 26, 2018 against EP2644759, 1 page.

PBI Performance Products, Inc., "Brochure—PBI Gold vs Traditional Outer Shell Fabrics, The Gold Standard of Protection", cited in Opposition filed against EP2644759 on Jan. 26, 2018, 2 pages.

PBI Performance Products, Inc, "Brochure—PBI Matrix Performance Properties", cited in Opposition filed against EP2644759 on Jan. 26, 2018, 2 pages.

PBI Performance Products, Inc., "PBI Gold", https://web.archive.org/web/20111023234640/http://www.pbiproducts.com:80/en/pbi_fiber/pbi_gold, cited in Opposition filed against EP2644759 on Jan. 26, 2018, 2 pages.

PBI Performance Products, Inc., "PBI Matrix" https://web.archive.org/web/20111026100322/http://ww.pbiproducts.com:80/en/pbi_fiber/pbi_matrix, cited in Opposition filed against EP2644759 on Jan. 26, 2018, 1 page.

International Patent Application No. PCT/US2020/063411, International Search Report and Written Opinion, Feb. 16, 2021, 14 pages.

Perepelkin et al., "Properties of Armos Para-Aramid Fibres in Conditions of Use. Comparison with Other Para-Aramids", Fibre Chemistry, vol. 33, No. 2, 2001, pp. 105-114.

Safety Components , "Filament Twill Technology", available on the internet at least as early as Jan. 10, 2017 at www.http://safetycomponents.com/FTT/, 2 pages.

Safety Components, "Armor 7.0—Maximum Protection in Extreme Conditions", cited in Opposition filed Jan. 26, 2018 against EP2644759 on Jan. 26, 2018, 3 pages.

Safety Components Fabric Technology, "Advertisement: Filament Armor Technology . . . There's a New Outer Shell Technology in Town", cited in Opposition filed against EP2644759 on Jan. 26, 2018, 1 page.

Office Action, Colombian Patent Application No. NC2022/0008031, Jan. 30, 2024, 18 pages.

United Arab Emirates Patent Application No. P6001047/2022, Office Action, Dec. 17, 2024, 7 pages.

European Patent Application No. 20825406.0, Office Action, Mar. 5, 2024, 4 pages.

European Patent Application No. 20825406.0, Office Action, Jan. 2, 2025, 6 pages.

Japanese Patent Application No. 2022-533111, Office Action, Jul. 9, 2024, 9 pages.

* cited by examiner

FLAME RESISTANT FABRICS FORMED OF LONG STAPLE YARNS AND FILAMENT YARNS

CROSS-REFERENCE TO RELATED APPLICATIONS

This application claims the benefit of U.S. Provisional Application No. 62/943,968, filed Dec. 5, 2019, the entirety of which is hereby incorporated by reference.

FIELD

Embodiments of the present invention relate to flame resistant fabrics formed at least in part with long staple yarns and filament yarns.

BACKGROUND

Protective garments are designed to protect the wearer from hazardous environmental conditions the wearer might encounter. Such garments include those designed to be worn by firefighters and other rescue personnel, industrial and electrical workers, and military personnel.

Standards have been promulgated that govern the performance of such garments (or constituent layers or parts of such garments) to ensure that the garments sufficiently protect the wearer in hazardous situations. For example, National Fire Protection Association (NFPA) 1971—*Standard on Protective Ensembles for Structural Fire Fighting and Proximity Fire Fighting* (2018 edition, incorporated herein by this reference) governs the required performance of firefighter garments. NFPA 2112—*Standard on Flame-Resistant Clothing for Protection of Industrial Personnel Against Short-Duration Thermal Exposures from Fire* (2012 edition, incorporated herein by this reference) governs the required performance of industrial worker garments that protect against flash fires. Both of these standards require that the garments and/or individual layers or parts thereof pass a number of different performance tests, including compliance with the thermal protective requirements of having a 4 inch (or less) char length and a 2 second (or less) afterflame when measured pursuant the testing methodology set forth in ASTM D6413—Standard Test Method for Flame Resistance of Textiles (Vertical Test) (2015 edition, the entirety of which is hereby incorporated by reference).

To test for char length and afterflame, a fabric specimen is suspended vertically over a flame for twelve seconds. The fabric must self-extinguish within two seconds (i.e., it must have a 2 second or less afterflame). After the fabric self-extinguishes, a specified amount of weight is attached to the fabric and the fabric lifted so that the weight is suspended from the fabric. The fabric will typically tear along the charred portion of the fabric. The length of the tear (i.e., the char length) must be 4 inches or less when the test is performed in both the machine/warp and cross-machine/weft directions of the fabric. A fabric sample is typically tested for compliance both before it has been washed (and thus when the fabric still contains residual—and often flammable—chemicals from finishing processes) and after a certain number of launderings (100 launderings for NFPA 2112 and 5 launderings for NFPA 1971).

Structural firefighters' garments, such as firefighters' turnout gear, typically consist of matching coat and pants and are designed primarily to prevent the wearer from sustaining a serious burn. NFPA compliant turnout gear or garments are typically comprised of three layers: an outer shell, an intermediate moisture barrier, and a thermal barrier lining. The outer shell is usually a woven fabric made from flame resistant fibers and is considered a firefighter's first line of defense. Not only should it resist flame, but it needs to be tough and durable so as not to be torn, abraded, or snagged during normal firefighting activities.

The moisture barrier, while also flame resistant, is present to keep water and harmful chemicals from penetrating and saturating the turnout gear. Excess moisture entering the gear from the outside would laden the firefighter with extra weight and increase his or her load.

The thermal barrier is flame resistant and offers the bulk of the thermal protection afforded by the ensemble. A traditional thermal barrier is a batting made of a nonwoven fabric of flame resistant fibers quilted to a lightweight woven facecloth also made of flame resistant fibers. The batting may be either a single layer of needle-punch nonwoven fabric or multiple layers of spun lace nonwoven fabric. The facecloth is commonly quilted to the batting in a cross-over or chicken wire pattern. The quilted thermal barrier is the innermost layer of the firefighter's garment, with the facecloth typically facing the wearer.

The thermal protection that a garment fabric affords the wearer is measured by determining the fabric's Thermal Protective Performance (TPP) in accordance with ISO 17492*: Clothing for protection against heat and flame—Determination of heat transmission on exposure to both flame and radiant heat* (2003 edition, incorporated herein by this reference), as modified by NFPA 1971. The TPP test predicts the rate at which radiant and convective heat transfer through the three layers of the garment fabric (outer shell, moisture barrier, and thermal liner) to a level that will cause a second-degree burn to the human skin. More specifically, the test measures the amount of time at a given energy level it takes for enough heat to pass through the composite to cause a second degree burn. The minimum TPP rating for NFPA 1971-compliant coats and trousers is 35 calories/cm$^2$ (which equates to about 17.5 seconds of protection before a second-degree burn results). The higher the number, the more protective the garment system is considered. The TPP test method is fully described in chapter 8.10 of NFPA 1971.

While TPP is a measure of the ability of the garment fabric to protect the wearer from heat and flame, it must be balanced with the Total Heat Loss (THL) of the fabric. THL measures the ability of the garment fabric to allow heat and moisture vapor to escape from the wearer through the fabric to thereby avoid heat stress on the wearer.

The testing methodology used for measuring THL is set forth in ASTM F 1868-14*: Standard Test Method for Thermal and Evaporative Resistance of Clothing Materials Using a Sweating Hot Plate* (2002, incorporated herein by this reference), as modified by NFPA 1971. Generally, however, the garment fabric (consisting of the outer shell, moisture barrier, and thermal liner) is laid on a 35° C. (+/−0.5° C.) hot plate in an environment with an air temperature of 25° C. (+/−0.5° C.). The test is conducted with both a wet and a dry hot plate. The amount of energy (measured in watts/m$^2$) it takes to maintain the hot plate at 98.6° F. is measured. Higher THL values mean that more energy must be supplied to the plate to maintain the temperature because the fabric is permitting heat to escape through the garment fabric. Thus, the higher the THL value, the less insulative the fabric but the less risk of the fabric contributing the heat stress of the wearer. A minimum THL value of 205 watts/m$^2$ is required to comply with NFPA 1971.

Fabrics used in these environments should also be strong. The strength of such fabrics, such as the outer shell of a firefighter's turnout garment, may be gauged by assessing the fabric's tear strength and tensile strength.

Tear strength is the force required either to start or to continue or propagate a tear in a fabric. ASTM 5587-05: *Standard Test Method for Tearing Strength of Fabrics by Trapezoid Procedure* (2015 edition, incorporated herein by this reference) measures tear strength. According to this method, an outline of an isosceles trapezoid is marked on a rectangular specimen cut for the determination of tearing strength. The specimen is slit at the smallest base of the trapezoid to start the tear. The nonparallel sides of the trapezoid marked on the specimen are clamped in parallel jaws of a tensile testing machine. The separation of the jaws is continuously increased to apply a force to propagate the tear across the specimen. At the same time, the force developed is recorded. The maximum force to continue the tear is calculated from autographic chart recorders, or microprocessor data collection systems.

Tensile strength is the force required to break a fabric under a load, and is measured in accordance with ASTM D5034-09: *Standard Test Method for Breaking Strength and Elongation of Textile Fabrics* (*Grab Test*) (2013 edition, incorporated herein by this reference). According to this method, a specimen is mounted centrally in clamps of a tensile machine and a force is applied until the specimen breaks. Values for the breaking force and the elongation of the test specimen are obtained from machine scales, dials, autographic recording charts, or a computer interfaced with the testing machine.

NFPA 1971 also contains requirements relating to the extent to which the fabric shrinks when subjected to heat when tested pursuant to ASTM F2894-19: *Standard Test Method for Evaluation of Materials, Protective Clothing, and Equipment for Heat Resistance Using a Hot Air Circulating Oven* (2014 edition, incorporated herein by this reference). To conduct thermal shrinkage testing on outer shell fabrics, marks are made on the fabric a distance from each other in both the machine/warp and cross-machine/weft directions. The distance between sets of marks is noted. The fabric is then suspended in a 500 degree Fahrenheit oven for 5 minutes. The distance between sets of marks is then re-measured. The thermal shrinkage of the fabric is then calculated as the percentage that the fabric shrinks in both the machine/warp and cross-machine/weft directions and must be less than the percentage set forth in the applicable standard. For example, NFPA 1971 requires that outer shell fabrics exhibit thermal shrinkage of no more than 10% in both the machine/warp and cross-machine/weft directions.

NFPA 1971 also includes requirements relating to the extent to which complaint fabrics can shrink when laundered pursuant to AATCC 135, 1, V, Ai—*Dimensional Changes of Fabrics after Home Laundering* (2004 edition, incorporated herein by reference). This property is referred to as dimensional stability or laundry shrinkage. NFPA 1971 compliant fabrics are required to shrink less than 5% in both the warp and weft directions.

The water resistance of the fabric is also important. A fabric that absorbs water becomes heavier and imposes more of a burden on the wearer. Thus, it is desirable that fabrics, such as those used for outer shells, are water resistant so as not to absorb water. The water repellency of a fabric may be tested pursuant to AATCC 42—*Water Resistance: impact Penetration Test* (2013 edition, incorporated herein by reference). Under AATCC 42, the fabric is soaked in water and the weight of the wet fabric is measured. The fabric is allowed to dry for 24 hours, after which its weight is measured again. The percent change between the weight of the wet and dry fabric is calculated. The lower the percentage, the less water the fabric absorbed during soaking.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention relate to flame resistant fabrics formed of a combination of filament and long staple yarns that exhibit excellent physical and thermal properties at relatively light weights.

In some embodiments, the flame resistant fabric includes a plurality of long staple yarns formed of a plurality of long staple fibers of flame resistant material. The fabric also includes a plurality of filament yarns including flame resistant material. In some embodiments the flame resistant fabric is devoid of short staple yarns.

In some embodiments, the flame resistant fabric is a woven fabric having a warp direction and a fill direction. The woven flame resistant fabric includes a plurality of flame resistant long staple yarns extending in both the warp and fill directions, where at least some of the plurality of long staple yarns have a fiber blend that includes a plurality of first long staple fibers of a first type of material and a plurality of second long staple fibers of a second type of material different from the first type of material. The fabric also includes a plurality of flame resistant filament yarns interwoven with the plurality of long staple yarns in both the warp and fill directions.

In some embodiments, the flame resistant fabric is a woven fabric having a warp direction and a fill direction. The woven flame resistant fabric includes flame resistant first long staple yarns extending in both the warp and fill directions, where each first long staple yarn has a fiber blend formed of a plurality of first long staple fibers of a first type of material and a plurality of second long staple fibers of a second type of material different from the first type of material. The fabric also includes flame resistant second long staple yarns extending in both the warp and fill directions, where each second long staple yarn is formed of a single type of material. The fabric also includes flame resistant filament yarns interwoven with the first and second long staple yarns in both the warp and fill directions, where each end of the first long staple yarns includes at least two first long staple yarns plied together, where each end of the second long staple yarns includes at least two second long staple yarns plied together and where more than three but less than eight first long staple yarn ends and second long staple yarn ends are collectively provided between adjacent filament yarn ends in at least one of the warp direction or the fill direction.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

As used herein, a "filament yarn" or "continuous filament yarn" refers to a yarn composed of one or more fibers or "filaments" of an indefinite or extreme length, such as found naturally within silk. Filament yarn is measured in units of denier. Filament yarns may be formed of a single filament, called a mono-filament. Fishing line is an example of a mono-filament yarn. In contrast, some filament yarns are formed of multiple filaments that are twisted together to form a filament yarn (referred to as multi-filament yarns). Both mono-filament and multi-filament yarns are considered filament yarns.

As used herein, "short staple yarns" are yarns formed of short staple fibers, such as fibers having lengths of 2 inches or less. Unlike filament yarn, short staple yarns are measured by yarn count (e.g., metric count).

As used herein, a "long staple yarn" refers to a yarn formed from long staple fibers. Long staple fibers are defined as fibers having a length longer than 2 inches up to about 40 inches. Long staple yarns are formed from long staple fibers using systems and methods designed specifically for use with long staple fibers. Those skilled in the art will recognize that systems and methods for forming long staple yarns are distinguishable from systems and methods for forming short staple yarns, which utilize shorter fibers (i.e., short staple fibers). Long staple yarns are measured by yarn count, similar to short staple yarns.

Long staple fibers useful in the invention may be formed by any of a variety of processes known to one of skill in the art, including, but not limited to, a stretch-break process (see *Continuous Filament to Staple Length Conversion* document, a copy of which is attached hereto), cutting continuous fiber into long staple length, or harvesting long staple fibers by shearing animals (e.g., to obtain long staple wool fibers). As one example, during the stretch break process, the long staple fibers are formed by breaking filaments to form non-continuous long staple fibers having lengths of greater than 2 up to approximately 40 inches. These and other processes for forming long staple fibers may provide long staple fibers of uniform length or non-uniform length. Similarly, the long staple fibers in the long staple yarns suitable for use in embodiments of the invention may be of the same or different lengths.

Long staple yarns may be formed from long staple fibers using systems and processes designed specifically for use with long staple fibers. Such long staple fiber systems and processes include, but are not limited to, woolen and worsted systems and processes.

Embodiments of the invention include a flame resistant fabric including a combination of yarns of which at least some are long staple yarns and at least some are filament yarns. In some embodiments, the fabric is devoid of short staple yarns; however, short staple yarns may be included in other embodiments.

In some examples of the invention, the long staple yarns include flame resistant ("FR") long staple fibers, such as inherently FR long staple fibers or long staple fibers that have been treated to be flame resistant. In some embodiments, the long staple yarns may include at least some non-FR long staple fibers. Exemplary FR and non-FR materials useful for forming the long staple fibers and long staple yarns of the invention include, but are not limited to, aramids (including para-aramid and meta-aramid); polybenzimidazole ("PBI"); polybenzoxazole ("PBO"); modacrylic; poly{2,6-diimidazo [4,5-b:40; 50-e]-pyridinylene-1,4(2,5-dihydroxy)phenylene} ("PIPD"); ultra-high molecular weight ("UHMW") polyethylene; UHMW polypropylene; polyvinyl alcohol; polyacrylonitrile; liquid crystal polymer; glass; nylon; carbon; silk; polyamide; polyester; and natural and synthetic cellulosics (e.g., cotton, rayon, acetate, triacetate, and lyocell fibers, as well as their flame resistant counterparts FR cotton, FR rayon, FR acetate, FR triacetate, and FR lyocell), TANLON™ fibers (available from Shanghai Tanlon Fiber Company), wool, melamine (such as BASOFIL™, available from Basofil Fibers), polyetherimide, polyethersulfone, pre-oxidized acrylic, polyamide-imide fibers such as KERMEL™, polytetrafluoroethylene, polyvinyl chloride, polyetheretherketone, polyetherimide fibers, polychlal, polyimide, polyimideamide, polyolefin, polyacrylate, and any combination or blend thereof.

Examples of para-aramid materials include KEVLAR™ (available from DuPont), TECHNORA™ (available from Teijin Twaron BV of Arnheim, Netherlands), and TWARON (also available from Teijin Twaron By). Examples of meta-aramid materials include NOMEX™ (available from DuPont), CONEX™ (available from Teijin), and Kermel (available from Kermel). An example of a suitable modacrylic material is PROTEX™ available from Kaneka Corporation of Osaka, Japan. An example of a PIPD material includes M5 (Dupont). Examples of UHMW polyethylene materials include polymer material is VECTRAWM (available from Kuraray). Examples of suitable rayon materials are Viscose™ and Modal™ by Lenzing, available from Lenzing Fibers Corporation. An example of an FR rayon material is Lenzing FR™, also available from Lenzing Fibers Corporation. Examples of lyocell material include TENCEL G100™ and TENCEL AlOO™, both available from Lenzing Fibers Corporation.

In some embodiments, all of the long staple yarns in the fabric may be formed with 100% of a single type of fiber material, such that all of the long staple yarns in the fabric include the same fiber material. Alternatively, two or more different types of fiber materials may be used in the long staple yarns, where each long staple yarn includes 100% of a single type of fiber material, but different long staple yarns do not necessarily include the same type of fiber material. Still further, two or more different types of fiber materials may be blended in a single long staple yarn, where each long staple yarn in the fabric includes the same fiber blend or where blended yarns are present along with single-material long staple yarns and/or along with long staple yarns including a different fiber blend. For example, in one embodiment the fabric may be formed of two different types of long staple yarns—one type formed 100% of one material (e.g., aramid long staple fibers) and one type formed of a blend of long staple fibers (e.g., aramid and PBI long staple fibers). In any case, the long staple yarns in the fabric all may be formed of the same materials or at least some of the long staple yarns in the fabric may be formed of different materials as compared to other long staple yarns in the fabric. For example, different long staple yarns in the fabric may include fiber blends that differ based on the types of fiber materials in the blend or based on the ratio of fiber materials in the blend.

In some embodiments, an end of a long staple yarn may be formed by a single long staple yarn. In another embodiment, ends of long staple yarns may be combined, coupled, or covered (i.e., plied, ply twist, wrapped, coresheath, coverspun, etc.) with one or more other yarn, such as a filament yarn or another long staple yarn. Alternatively, the long staple yarns may be combined, coupled or covered with one or more short staple yarns; however, in other embodiments the long staple yarns are not combined, coupled, or covered with any short staple yarn. Further, in some embodiments, the fabric does not include (i.e., the fabric is devoid of) any short staple yarns and/or fibers. In some embodiments, the long staple yarns have an English cotton count in the range of 7/1 to 20/1 (or equivalent denier as plied or twisted yarns). For example, a plied long staple yarn might have an English cotton count in the range of 14/2 to 40/2.

The filament yarns may be mono- or multi-filament yarns of a denier between 200-1200, inclusive; 200-800, inclusive and 200-600 inclusive. An end of a filament yarn may be formed only of one or more filaments or may be combined, coupled, or covered with one or more other yarns, as described above with respect to long staple yarns. The filament yarns may be formed of inherently FR fibers or fibers that have been treated to be flame resistant. Materials useful as filament yarns in the inventive fabrics include, but are not limited to, the same fibers identified above for use in the long staple yarns. The long staple yarns and filament yarns can include any combination of FR/non-FR materials, as long as the overall fabric is flame resistant and/or satisfies the applicable or desired standards for flame resistant fabrics. As one example, the fabric may be a protective fabric suitable for use in fire service apparel (such as the outer shell of a firefighter's turnout coat) and thus preferably complies with the heat, flame, and fire performance and safety standards (e.g. thermal shrinkage, vertical flammability, and char length requirements), as set forth in, for example, NFPA 1971. However, the flame resistant fabric contemplated herein can be used in any suitable application and is not limited to use only in the fire service industry.

In some embodiments, at least some or all of the long staple yarns are formed of long staple fibers formed of a single type of material, such as PBI or aramid (meta- or para-aramid) long staple fibers. In some embodiments, at least some or all of the long staple yarns are formed from a blend of at least a first long staple fiber and a second long staple fiber made from a material (or materials) different from the first long staple fiber. In some embodiments, the first long staple fiber constitutes 30% to 65% and the second long staple fiber constitutes 35% to 70% of the fiber blend of the long staple yarn. In some embodiments, the first long staple fiber constitutes 30% to 45% and the second long staple fiber constitutes 55% to 70% of the fiber blend of the long staple yarn. In some embodiments, the first long staple fiber is an aramid fiber (such as para-aramid) that constitutes 30% to 65% (or 30% to 45%) of the fiber blend and the second long staple fiber is PBI fiber that constitutes 40% to 70% (or 55% to 70%) of the fiber blend. In some embodiments, the long staple yarns include PBI long staple fibers. In some embodiments, PBI material is only present in the long staple yarns and/or is not present in the filament yarns. In some embodiments, the overall percentage by weight of PBI in the fabric is between 30% to 60%, inclusive; 35% to 55%, inclusive; or 40% to 50%, inclusive. In some embodiments, the overall percentage by weight of PBI in the fabric is at least 30%, at least 35%, or at least 40%. In some embodiments, at least some or all of the filament yarns are formed from aramid fibers and more specifically from para-aramid fibers. In some embodiments, the long staple yarns, the filament yarns, and/or the fabric is formed entirely from inherently FR materials.

The flame resistant fabric described herein may include the long staple yarns and the filament yarn in any combination or orientation. For example, in some examples of the invention, the fabric may be a woven fabric that includes a warp direction and a fill direction. In such a fabric, the long staple yarns may be included in only the warp direction, in only the fill direction, or in both the warp and fill directions. Similarly, the filament yarns may be included in the fabric in only the warp direction, in only the fill direction, or in both the warp and fill directions. In some embodiments, the fabric includes a plurality of long staple yarns in both the warp and fill directions and a plurality of filament yarns interwoven with the plurality of long staple yarns in both the warp and fill directions. In still other embodiments, the fabric includes long staple yarns and filament yarns both provided in one direction and only one of long staple yarns or filament yarns provided in the other direction.

In other exemplary embodiments, the long staple yarns and/or filament yarns are woven or knitted into the fabric in a grid pattern or a stripe (e.g., horizontal or vertical) pattern. Any desirable weave (e.g., plain, twill) or knit (e.g., single, double, plain, interlock) pattern may be used.

The long staple yarns may be located in the fabric relative to the filament yarns in any desired ratio. The ratio of long staple yarns to filament yarns may be the same or different (1) within a direction of the fabric and/or (2) in different directions of the fabric. The ratio is calculated by counting the yarn ends. For example, when considering a plied yarn (e.g., a long staple yarn plied with another long staple yarn), each long staple yarn is not considered individually for purposes of determining the ratio but rather the two plied yarns together are considered as a single end. For example, consider a fabric woven in a pattern with the following yarn repeat: two yarns (each formed by plying two long staple yarns) followed by one filament yarn (mono- or multi-filament). The ratio of filament yarns to long staple yarns for such a fabric is 1:2 based on each yarn end.

The yarn ratio of filament yarns to long staple yarns in the fabric can be from about 40:1 to about 1:40, or from about 30:1 to about 1:30, or from about 25:1 to about 1:25, or from about 20:1 to about 1:20, or from about 15:1 to about 1:15, or from about 10:1 to about 1:10, or 9:1, or 8:1, or 7:1, or 6:1, or 5:1, or 4:1, or 3:1, or 2:1, or 1:1, or 1:2, or 1:3, or 1:4, or 1:5, or 1:6, or 1:7, or 1:8, or 1:9, or even from about 2:3 or 3:2 to about 1:3. In certain embodiments, the ratio of filament yarns to long staple yarns in the fabric is from 1:1 to 6:1 or any intermediate ratio in that range. In certain embodiments, the ratio of filament yarns to long staple yarns in the fabric is from 1:2 to 1:8, from 1:3 to 1:7, or from 1:4 to 1:6 or any intermediate ratio in that range.

The frequency of the occurrence of filament yarns as well as the number of filament yarns provided at each such occurrence may depend on the desired strength properties of the fabric as well as the size of the filament yarns. If a larger sized filament yarn is used, only one such yarn inserted every $n^{th}$ end and/or pick may provide sufficient strength to the fabric. Conversely, if a smaller filament yarn is used, two or more adjacent ends or picks of such yarns may be desired.

In some embodiments, the fabrics disclosed herein have a weight between 2-12 ounces per square yard ("osy"), inclusive; 3-10 osy, inclusive; 3-9 osy, inclusive; 3-8.5 osy, inclusive; 4-8 osy, inclusive; 4-7.5 osy, inclusive; 4-7 osy, inclusive; 4.5-6.5 osy, inclusive; 5-7 osy, inclusive; 5-6.5 osy, inclusive. In some embodiments, the fabric weight is 5-6 osy, inclusive, and/or is less than or equal to 6.5 osy and/or less than or equal to 6 osy.

The physical and thermal properties of fabrics formed in accordance with embodiments of the present invention ("Inventive Fabrics") were tested and compared against a control fabric. The fabrics were as follows:

Control Fabric[1]: 7 osy twill weave fabric formed of 2 different plied yarns that are as follows:

[1] Sold by TenCate Protective Fabrics under the name KOMBAT FLEX.

Plied Yarn A: two short staple yarns—each 50% PBI/50% Kevlar (20/2 cotton count)

Plied Yarn B: one short staple yarn (50% PBI/50% Kevlar, 20/1 cotton count) plied with a para-aramid monofilament yarn (400 denier).

The ratio of Yarn B to Yarn A in both the warp and fill direction was 1:2 (i.e., BAABAABAA, etc.).

Inventive Fabric 1: 5.6 osy twill weave fabric with long staple (stretch broken) yarns and filament yarns woven in both the warp and filling directions. The long staple yarns were formed of a blend of PBI (48%) and para-aramid (52%) long staple fibers. Each end of long staple yarns was formed by plying two long staple yarns so as to have an English cotton count of 29/2. The filament yarns were 400 denier, 100% para-aramid multi-filament yarns. The fabric was woven in each of the warp and filling directions in a pattern with six ends of long staple yarns followed by one end of filament yarn (i.e., 1:6 ratio of filament yarns: long staple yarn).

Inventive Fabric 2: 5.6 osy twill weave fabric with long staple (stretch broken) yarns and filament yarns woven in both the warp and filling directions. The long staple yarns were formed of a blend of PBI (63%) and para-aramid (37%) long staple fibers. Each end of long staple yarns was formed by plying two long staple yarns so as to have an English cotton count of 29/2. The filament yarns were 400 denier, 100% para-aramid multi-filament yarns. The fabric was woven in each of the warp and filling directions in a pattern with two ends of long staple yarns followed by one end of filament yarn (i.e., 1:2 ratio of filament yarns: long staple yarn).

Inventive Fabric 3: 5.6 osy twill weave fabric with long staple yarns and filament yarns woven in both the warp and filling directions. Two different long staple yarns (LSY) were used in the fabric. The first long staple yarns (LSY1) were formed of 100% para-aramid long staple fibers (i.e., a para-aramid stretch broken yarn). The second long staple yarns (LSY2) were formed of a blend of PBI (63%) and para-aramid (37%) long staple fibers. Each end of both types of long staple yarns was formed by plying two identical long staple yarns so as to have an English cotton count of 29/2. More specifically, each end of the LSY1 yarns was formed by plying two LSY1 yarns together, and each end of the LSY2 yarns was formed by plying two LSY2 yarns together. The filament yarns were 400 denier, 100% para-aramid multi-filament yarns. The fabric was woven in each of the warp and filling directions in a pattern with each filament yarn followed by five ends of long staple yarns (i.e., 1:5 ratio of filament yarns to long staple yarns). More specifically, each filament yarn was followed by long staple yarn ends in the following order: LSY2, LSY2, LSY1, LSY2, LSY2. The overall percentage of PBI in the fabric was approximately 40%.

The performance results of these Fabrics are set forth in Table 1.

TABLE 1

| Tested Property | Test Method | Control Fabric | Inventive Fabric 1 | Inventive Fabric 2 | Inventive Fabric 3 |
|---|---|---|---|---|---|
| Trap Tear (before wash or "BW") (pounds force or "lbf") | ASTM D 5587 | 72 × 81 | 74 × 70 | 119 × 124 | 90 × 80 |
| Trap Tear (after 5 washes* or "5X") (lbf) | ASTM D 5587 | 57 × 61 | 49 × 55 | 104 × 124 | 80 × 80 |
| Tensile Strength (BW) (lbf) | ASTM D 5034 | 289 × 287 | 327 × 297 | 319 × 289 | 370 × 350 |
| Tensile Strength (10X) (lbf) | ASTM D 5034 | 270 × 270 | — | — | 310 × 280 |
| Water Absorption (BW) (%) | AATCC 42 | 1.6 | 2.6 | 2.0 | <5% |
| Water Absorption (5X) (%) | AATCC 42 | 4.3 | 4.6 | 4.5 | <8% |
| Char Length (BW) (inches) | ASTM D 6413 | 0.3 × 0.5 | 0.3 × 0.3 | 0.4 × 0.5 | <0.4 × <0.4 |
| Char Length (5X) (inches) | ASTM D 6413 | 0.4 × 0.4 | 0.5 × 0.4 | 0.3 × 0.3 | <0.4 × <0.4 |
| After Flame (BW) (sec) | ASTM D 6413 | 0 × 0 | 0 × 0 | 0 × 0 | <2.0 × <2.0 |
| After Flame (5X) (sec) | ASTM D 6413 | 0 × 0 | 0 × 0 | 0 × 0 | <2.0 × <2.0 |
| Thermal shrinkage (BW) (%) | ASTM F2894 | — | — | — | <1% |
| Thermal shrinkage (5X) (%) | ASTM F2894 | — | — | — | <2% |
| Dimensional Stability | AATCC Method 135, 1, V, Ai | <5% | — | — | <5% |

*The fabrics were laundered in accordance with AATCC 135, 1, V, Ai.

The Fabrics described above were incorporated as outer shell fabrics into conventional material layups for firefighter's garments that comply with NFPA 1971 so as to form garment composites (i.e., fabric composites with an outer shell, moisture barrier, and thermal liner) for turnout gear. More specifically, the Fabrics were incorporated into the garment composites set forth in Table 2.

TABLE 2

| | Outer Shell | Moisture Barrier | Thermal Liner |
|---|---|---|---|
| Garment Composite 1 | Control Fabric | CROSSTECH BLACK ® | 2.3 osy spunlace 1.5 osy spunlace Caldura ® Facecloth |
| Garment Composite 2 | Inventive Fabric 1 | CROSSTECH BLACK ® | 2.3 osy spunlace 1.5 osy spunlace Caldura ® Facecloth |
| Garment Composite 3 | Inventive Fabric 2 | CROSSTECH BLACK ® | 2.3 osy spunlace 1.5 osy spunlace Caldura ® Facecloth |

TABLE 2-continued

| | Outer Shell | Moisture Barrier | Thermal Liner |
|---|---|---|---|
| Garment Composite 4 | Inventive Fabric 3 | CROSSTECH BLACK ® | 2.3 osy spunlace<br>1.5 osy spunlace<br>Caldura ® Facecloth |

Definitions of the terminology used in Table 2 are as follows:

"CROSSTECH BLACK®" refers to a capped ePTFE layer laminated to a woven meta-aramid fabric layer. This moisture barrier is flame resistant, air impermeable, vapor permeable, and waterproof. CROSSTECH BLACK® is available from Gore®.

The term "1.5 osy spunlace" is a non-apertured flame resistant spunlace fabric formed with 67% meta-aramid/33% para-aramid fibers having a weight of approximately 1.5 osy.

The term "2.3 osy spunlace" is a non-apertured flame resistant spunlace fabric formed with 67% meta-aramid/33% para-aramid fibers having a weight of approximately 2.3 osy.

The term "Caldura® Facecloth" refers to a flame resistant woven fabric formed of 100% para-aramid filament yarns in the fill direction woven with spun yarns in the warp direction formed of a blend of 65% rayon fibers/25% para-aramid fibers/10% nylon. The fabric weighs approximately 3.5 osy and is available from TenCate®.

The thermal liners were positioned in the garment composites such that the top layer of the thermal liner (the 2.3 osy spunlace layer) was positioned adjacent the moisture barrier. The garment composites were tested for TPP performance pursuant to ISO 17492 (as modified by NFPA 1971) and THL performance pursuant to ASTM F 1868 (as modified by NFPA 1971), and the results are set forth in Table 3 below.

TABLE 3

| Garment Composite | TPP (calories/cm$^2$) (BW) | THL (watts/m$^2$) (BW) |
|---|---|---|
| 1 | 40.8 | 269 |
| 2 | 40.0 | — |
| 3 | 40.4 | — |
| 4 | 38.7 | 286 |

Long staple yarns can impart higher strength to fabrics as compared to short staple yarns. Thus, a fabric including long staple yarns will be stronger than a fabric that differs only by including short staple yarns instead of the long staple yarns. Further, when long staple yarns are used in place of weaker short staple yarns, the overall weight of the fabric may be decreased while maintaining or increasing the strength of the fabric. This is demonstrated in the above results whereby Inventive Fabrics 1, 2, and 3 demonstrated comparable or increased strength properties than the Control Fabric despite weighing 20% less than the Control Fabric.

Table 4 below sets forth ratios of the strength properties (from Table 1) to weight for the Control Fabric and Inventive Fabrics 1-3.

TABLE 4

| Ratio | Control Fabric | Inventive Fabric 1 | Inventive Fabric 2 | Inventive Fabric 3 |
|---|---|---|---|---|
| Trap Tear Strength (BW) to weight | 10.28 × 11.57 | 13.21 × 12.5 | 21.25 × 22.14 | 16.07 × 14.28 |
| Trap Tear Strength (5X) to weight | 8.14 × 8.7 | 8.75 × 9.82 | 18.57 × 22.14 | 14.28 × 14.28 |
| Tensile Strength (BW) to weight | 41.28 × 41 | 58.39 × 53 | 56.96 × 51.6 | 66.07 × 62.5 |
| Tensile Strength (10X) to weight | 38.57 × 38.57 | — | — | 55.36 × 50 |

In every reported instance, the strength property to weight ratio was greater with the Inventive Fabrics than with the Control Fabric.

In some embodiments, the trap tear strength (BW) to weight ratio in at least one of the warp or weft fabric directions, or in both the warp and weft fabric directions, is at least 12; at least 13; at least 14; at least 15; at least 16; at least 17; at least 18; at least 19; at least 20; at least 21; or at least 22. In some embodiments, the trap tear strength (BW) to weight ratio in at least one of the warp or weft directions, or in both the warp and weft directions, is between 12 and 24, inclusive; between 13 and 22, inclusive; between 14 and 20, inclusive; between 13 and 17, inclusive; or between 14 and 17, inclusive.

In some embodiments, the trap tear strength (5×) to weight ratio in at least one of the warp or weft fabric directions, or in both the warp and weft fabric directions, is at least 8; at least 9; at least 10; at least 11; at least 12; at least 13; at least 14; at least 15; at least 16; at least 17; at least 18; at least 19; at least 20; at least 21; or at least 22. In some embodiments, the trap tear strength (BW) to weight ratio in at least one of the warp or weft directions, or in both the warp and weft directions, is between 8 and 24, inclusive; between 9 and 22, inclusive; between 12 and 20, inclusive; between 13 and 17, inclusive; between 13 and 15, inclusive; or between 14 and 16, inclusive.

In some embodiments, the tensile strength (BW) to weight ratio in at least one of the warp or weft fabric directions, or in both the warp and weft fabric directions, is at least 45; at least 50; at least 55; at least 60; or at least 65. In some embodiments, the tensile strength (BW) to weight ratio in at least one of the warp or weft fabric directions, or in both the warp and weft fabric directions, is between 50 and 70, inclusive; between 50 and 60, inclusive; between 55 and 70, inclusive; between 55 and 65, inclusive; or between 60 and 70, inclusive.

In some embodiments, the tensile strength (10×) to weight ratio in at least one of the warp or weft fabric directions, or in both the warp and weft fabric directions, is at least 45; at least 50; or at least 55. In some embodiments, the tensile strength (10×) to weight ratio in at least one of the warp or weft fabric directions, or in both the warp and weft fabric directions, is between 40 and 60, inclusive; between 45 and 60, inclusive; or between 50 and 60, inclusive.

EXAMPLES

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. A flame resistant fabric comprising a plurality of long staple yarns comprising a plurality of long staple fibers comprising flame resistant material; and a plurality of filament yarns comprising flame resistant material, wherein the flame resistant fabric is devoid of short staple yarns.

Example 2. The flame resistant fabric of any of the preceding or subsequent examples or combination of examples, wherein at least some of the plurality of long staple yarns comprise a fiber blend comprising first long staple fibers comprising a first type of flame resistant material and second long staple fibers comprising a second type of flame resistant material different from the first type of flame resistant material.

Example 3. The flame resistant fabric of any of the preceding or subsequent examples or combination of examples, wherein the first type of flame resistant material is aramid and the second type of flame resistant material is PBI.

Example 4. The flame resistant fabric of any of the preceding or subsequent examples or combination of examples, wherein the first long staple fibers comprise 30-45% of the fiber blend and the second long staple fibers comprise 55 to 70% of the fiber blend.

Example 5. The flame resistant fabric of any of the preceding or subsequent examples or combination of examples, wherein the first type of flame resistant material is aramid and the second type of flame resistant material is polybenzimidazole.

Example 6. The flame resistant fabric of any of the preceding or subsequent examples or combination of examples, wherein the long staple fibers of at least some of the plurality of long staple yarns comprise a single type of flame resistant material.

Example 7. The flame resistant fabric of any of the preceding or subsequent examples or combination of examples, wherein the long staple fibers of other of the plurality of long staple yarns comprise a single type of flame resistant material, wherein the single type of flame resistant material is the same as the first type of flame resistant material.

Example 8. The flame resistant fabric of any of the preceding or subsequent examples or combination of examples, wherein the first type of flame resistant material comprises para-aramid.

Example 9. The flame resistant fabric of any of the preceding or subsequent examples or combination of examples, wherein at least some of the plurality of long staple yarns are plied with another yarn.

Example 10. The flame resistant fabric of any of the preceding or subsequent examples or combination of examples, wherein the flame resistant material of at least some of the plurality of filament yarns comprises aramid.

Example 11. The flame resistant fabric of any of the preceding or subsequent examples or combination of examples, wherein the fabric comprises one to six long staple yarn ends for every one filament yarn end extending in at least one direction of the fabric.

Example 12. The flame resistant fabric of any of the preceding or subsequent examples or combination of examples, wherein the fabric comprises a warp direction and a fill direction and wherein the plurality of long staple yarns and filament yarns are provided in both the warp and fill directions.

Example 13. The flame resistant fabric of any of the preceding or subsequent examples or combination of examples, wherein at least three, but less than eight, long staple yarn ends are provided between adjacent filament yarn ends in at least one of the warp direction or the fill direction.

Example 14. The flame resistant fabric of any of the preceding or subsequent examples or combination of examples, wherein the fabric comprises a weight between 4-7 ounces per square yard, inclusive.

Example 15. A woven flame resistant fabric having a warp direction and a fill direction, the fabric comprising a plurality of flame resistant long staple yarns extending in both the warp and fill directions, wherein at least some of the plurality of long staple yarns comprise a fiber blend comprising a plurality of first long staple fibers comprising a first type of material and a plurality of second long staple fibers comprising a second type of material different from the first type of material; and a plurality of flame resistant filament yarns interwoven with the plurality of long staple yarns in both the warp and fill directions.

Example 16. The woven flame resistant fabric of any of the preceding or subsequent examples or combination of examples, wherein at least other of the plurality of flame resistant long staple yarns comprise a single type of material.

Example 17. The woven flame resistant fabric of any of the preceding or subsequent examples or combination of examples, wherein the single type of material and the first type of material are the same.

Example 18. A woven flame resistant fabric having a warp direction and a fill direction, the fabric comprising flame resistant first long staple yarns extending in both the warp and fill directions, wherein each first long staple yarn comprises a fiber blend comprising a plurality of first long staple fibers comprising a first type of material and a plurality of second long staple fibers comprising a second type of material different from the first type of material; flame resistant second long staple yarns extending in both the warp and fill directions, wherein each second long staple yarn is formed of a single type of material; and flame resistant filament yarns interwoven with the first and second long staple yarns in both the warp and fill directions, wherein each end of the first long staple yarns comprises at least two first long staple yarns plied together, wherein each end of the second long staple yarns comprises at least two second long staple yarns plied together; and wherein more than three but less than eight first long staple yarn ends and second long staple yarn ends are collectively provided between adjacent filament yarn ends in at least one of the warp direction or the fill direction.

Example 19. The woven flame resistant fabric of any of the preceding or subsequent examples or combination of examples, wherein the single type of material and the first type of material are the same.

Example 20. The woven flame resistant fabric of any of the preceding or subsequent examples or combination of examples, wherein the first type of material comprises para-aramid and the second type of material comprises polybenzimidazole.

Different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A flame resistant fabric comprising:

(a) a plurality of first long staple yarns formed of a first fiber composition comprising a plurality of first long staple fibers having a length of greater than 2 inches up to about 40 inches, the first long staple fibers comprising a first flame resistant material;

(b) a plurality of second long staple yarns formed of a second fiber composition comprising a plurality of second long staple fibers having a length of greater than 2 inches up to about 40 inches, the second long staple fibers comprising a second flame resistant material different from the first flame resistant material, wherein the second fiber composition is different from the first fiber composition; and (c) a plurality of flame resistant filament yarns, wherein the flame resistant fabric is devoid of short staple fibers having a length of 2 inches or less.

2. The flame resistant fabric of claim 1, wherein the first fiber composition further comprises a plurality of third long staple fibers having a length of greater than 2 inches up to about 40 inches and comprising a third flame resistant material.

3. The flame resistant fabric of claim 2, wherein the first flame resistant material is polybenzimidazole and the third flame resistant material is aramid.

4. The flame resistant fabric of claim 2, wherein the first fiber composition comprises 30-45% of the plurality of third long staple fibers and 55 to 70% of the plurality of first long staple fibers.

5. The flame resistant fabric of claim 4, wherein the first flame resistant material is polybenzimidazole and the second flame resistant material is aramid.

6. The flame resistant fabric of claim 1, wherein the second fiber composition comprises only the second flame resistant material.

7. The flame resistant fabric of claim 2, wherein the second flame resistant material and the third flame resistant material are the same.

8. The flame resistant fabric of claim 7, wherein the first flame resistant material comprises polybenzimidazole.

9. The flame resistant fabric of claim 1, wherein at least some of the plurality of first long staple yarns or the plurality of second long staple yarns are plied with another yarn.

10. The flame resistant fabric of claim 1, wherein at least some of the plurality of flame resistant filament yarns comprise aramid.

11. The flame resistant fabric of claim 1, wherein the fabric comprises two to six ends of the first and second long staple yarns, collectively, for every one filament yarn end extending in at least one direction of the fabric.

12. The flame resistant fabric of claim 1, wherein the fabric comprises a warp direction and a fill direction and wherein the plurality of first long staple yarns, the plurality of second long staple yarns, and the plurality of flame resistant filament yarns are provided in both the warp and fill directions.

13. The flame resistant fabric of claim 12, wherein at least three, but less than eight, ends of the first and second long staple yarns, collectively, are provided between adjacent filament yarn ends in at least one of the warp direction or the fill direction.

14. The flame resistant fabric of claim 1, wherein the fabric comprises a weight between 4-7 ounces per square yard, inclusive.

15. A woven flame resistant fabric having a warp direction and a fill direction, the fabric comprising:

(a) a plurality of first flame resistant long staple yarns comprising long staple fibers having a length of greater than 2 inches up to about 40 inches, the plurality of first flame resistant long staple yarns extending in both the warp and fill directions, wherein the plurality of first flame resistant long staple yarns are formed of a fiber blend comprising a first plurality of the long staple fibers of a first flame resistant material and a second plurality of the long staple fibers of a second flame resistant material different from the first flame resistant material;

(b) a plurality of second flame resistant long staple yarns extending in both the warp and fill directions and comprising only a third flame resistant material, wherein the third flame resistant material is different from at least one of the first flame resistant material or the second flame resistant material; and (c) a plurality of flame resistant filament yarns interwoven with the plurality of first flame resistant long staple yarns and the plurality of second flame resistant long staple yarns in both the warp and fill directions.

16. The woven flame resistant fabric of claim 15, wherein the first flame resistant material and the third flame resistant material are the same.

17. A woven flame resistant fabric having a warp direction and a fill direction, the fabric comprising:

(a) flame resistant first long staple yarns extending in both the warp and fill directions, wherein each first long staple yarn is formed of a fiber blend comprising a plurality of first long staple fibers having a length of greater than 2 inches up to about 40 inches and of a first flame resistant material and a plurality of second long staple fibers having a length of greater than 2 inches up to about 40 inches and of a second flame resistant material different from the first flame resistant material;

(b) flame resistant second long staple yarns extending in both the warp and fill directions, wherein each second long staple yarn is formed entirely of a third flame resistant material, wherein the third flame resistant material is different from a least one of the first flame resistant material or the second flame resistant material; and (c) flame resistant filament yarns interwoven with the first and second long staple yarns in both the warp and fill directions, wherein:

each end of the first long staple yarns comprises at least two first long staple yarns plied together;

each end of the second long staple yarns comprises at least two second long staple yarns plied together; and more than three but less than eight first long staple yarn ends and second long staple yarn ends are collectively provided between adjacent filament yarn ends in at least one of the warp direction or the fill direction.

18. The woven flame resistant fabric of claim 17, wherein the third flame resistant material and the first flame resistant material are the same.

19. The woven flame resistant fabric of claim 18, wherein the first flame resistant material comprises para-aramid and the second flame resistant material comprises polybenzimidazole.

20. The woven flame resistant fabric of claim 16, wherein the first flame resistant material and the third flame resistant material are para-aramid.

* * * * *